United States Patent [19]

Solomon

[11] Patent Number: 4,910,810

[45] Date of Patent: Mar. 27, 1990

[54] TOILET SEAT MECHANISM

[76] Inventor: Davis Solomon, P.O. Box 110, Coogee, Sydney, New South Wales, Australia

[21] Appl. No.: 46,858

[22] PCT Filed: Jun. 30, 1986

[86] PCT No.: PCT/AU86/00187

§ 371 Date: Feb. 25, 1987

§ 102(e) Date: Feb. 25, 1987

[87] PCT Pub. No.: WO87/00412

PCT Pub. Date: Jan. 29, 1987

[30] Foreign Application Priority Data

Jul. 22, 1985 [AU] Australia ..... PH1573

[51] Int. Cl.[4] ..... A47K 13/10

[52] U.S. Cl. ..... 4/251; 4/253

[58] Field of Search ..... 4/251, 253

[56] References Cited

U.S. PATENT DOCUMENTS

| | | | |
|---|---|---|---|
| 2,772,422 | 12/1956 | Knudsen | 4/251 |
| 2,814,049 | 11/1957 | Mercur | 4/251 |
| 3,395,408 | 8/1968 | Weber et al. | 4/253 |
| 4,469,358 | 9/1984 | Abbott | 4/253 |

*Primary Examiner*—Joseph J. Hail, III

*Attorney, Agent, or Firm*—Poms, Smith, Lande & Rose

[57] ABSTRACT

A toilet seat assembly comprising a toilet seat and a seat lid (16) hingedly mounted on a toilet bowl so that the lid may be raised independently of the seat. A counterweight (17) or the like biases the seat to the raised position but is inoperative to raise the seat when the lid (16) is in its lowered position. When weight on the seat is removed, a suction cup (21) on the underside of the seat holds the seat in engagement with toilet bowl, but an air bleed to the suction cup releases the seat after a delay.

11 Claims, 2 Drawing Sheets

TOILET SEAT MECHANISM

This invention relates to toilet seats of the kind which are arranged automatically to lift from the toilet bowl when not in use, to facilitate maintaining the seat in a sanitary condition.

The prior art contains examples of mechanisms proposed for this purpose. Thus U.S. Pat. No. 2,812,522 of Wilson discloses a spring mechanism which is adapted to lift the seat unless the seat is held down by use or by the weight of the toilet seat cover, and a mechanism having a similar function is disclosed in U.S. Pat. No. 2,814,049 of Mercur.

Mechanisms such as these suffer from the disadvantage that the seat must be manually held in the lowered position until the user is seated, and furthermore the seat tends to lift immediately the user rises. As has been described in U.S. Pat. No. 2,353,133 of Sperzel et. al., the inconvenience resulting from these characteristics has prevented the wide employment of such mechanisms. The U.S. patent of Sperzel et. al. offers an improved arrangement incorporating a latch feature, but this arrangement does not provide a mechanism which overcomes the problem of the tendency of the seat to move towards its raised position immediately the user rises.

The object of the present invention is to provide a toilet seat mechanism which overcomes these disadvantages. In one form the invention comprises a toilet seat assembly comprising a seat provided with mounting means for hinged mounting on a toilet bowl, and a seat cover provided with mounting means for hinged mounting on said toilet bowl such that said lid may be raised independently of said seat, means biasing said seat to its raised position, said biasing means being inoperative to raise said seat when said cover is in its lowered position, and means releasably engaging the seat with the bowl for a predetermined time delay after release of other restraint on upward movement of the seat, said means being actuated into such engagement by the weight of said cover when said cover is in its lowered position.

In the accompanying drawings, a presently proposed embodiment of the invention is described by way of example.

Figure 1:
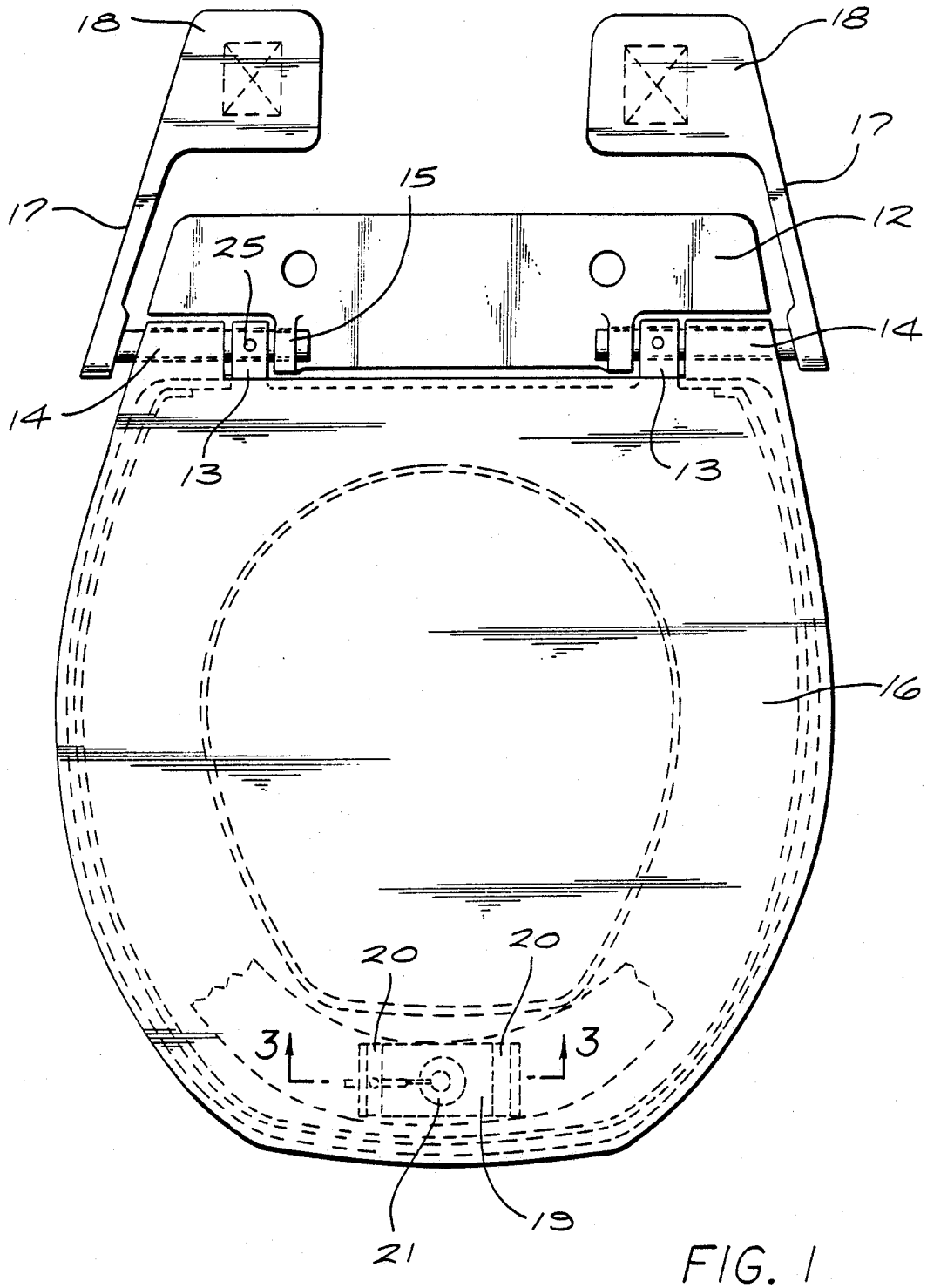
FIG. 1 is a plan view of a toilet seat mechanism incorporating the present invention.
Figure 3:
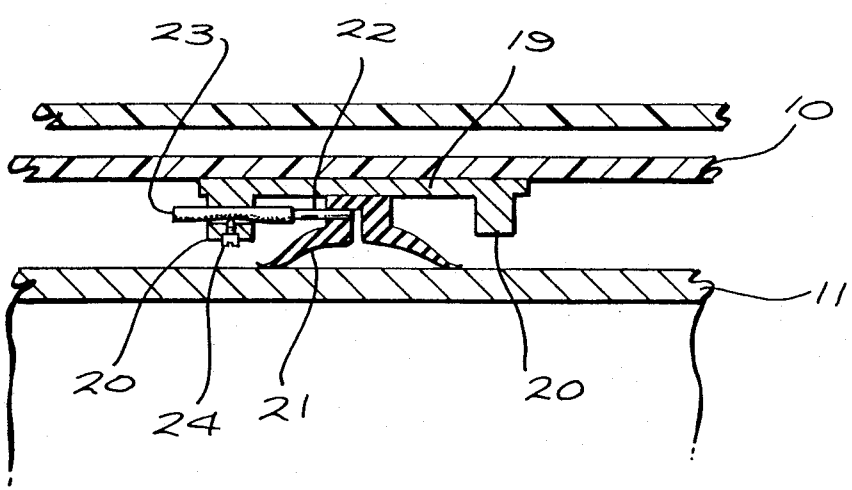
FIG. 3 is a fragmentary sectional elevation taken on the line 3—3 of FIG. 1.
Figure 2:
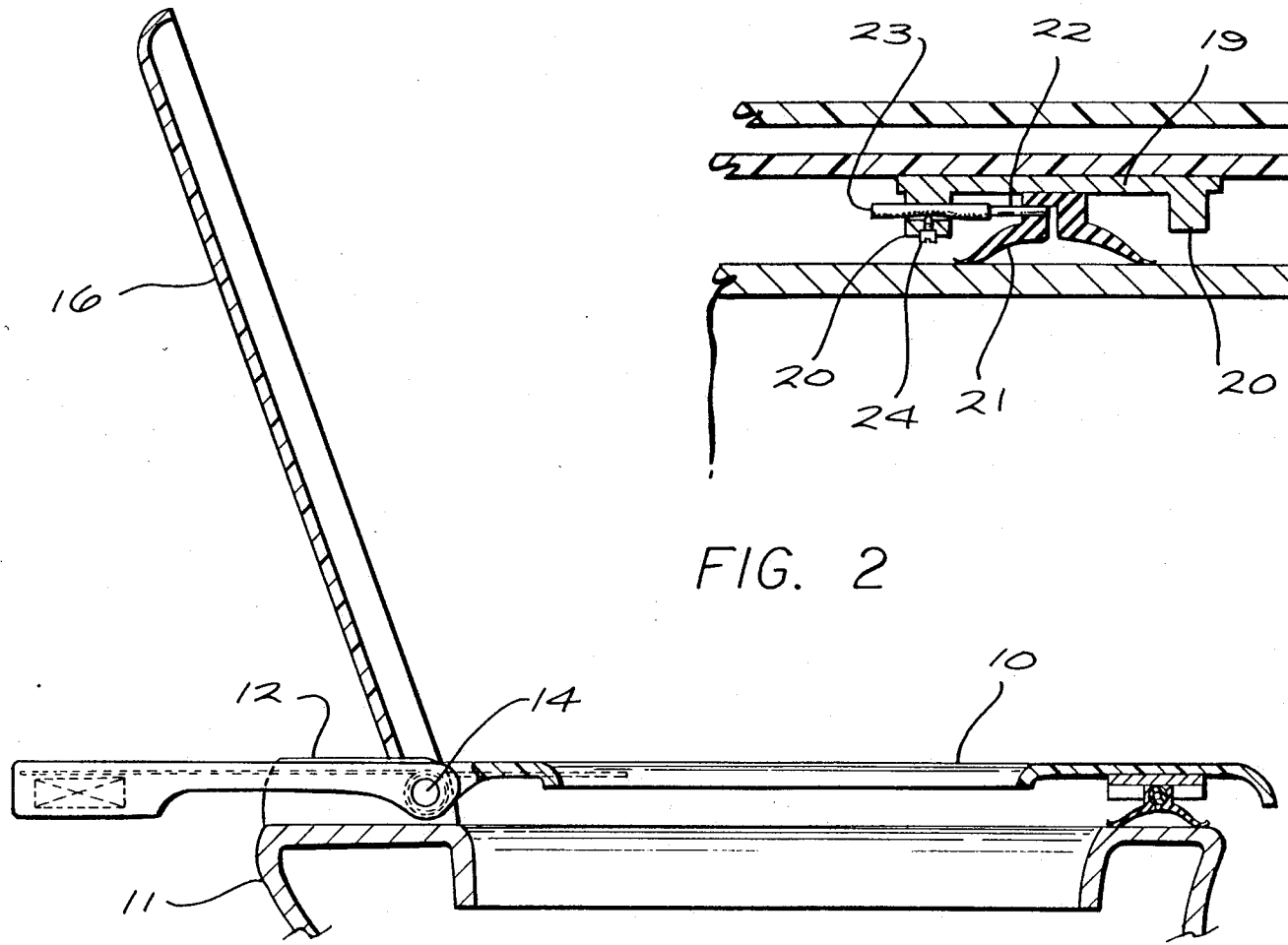
FIG. 2 is a side elevation of the arrangement illustrated in FIG. 1.

The illustrated assembly comprises a toilet seat 10 mounted on a bowl 11 by means of a mounting plate 12.

The seat 10 is attached by means of lugs 13 to a pair of shafts 14 which are journalled at 15 on the mounting plate 12, the lugs 13 being fastened to the shafts 14 by means of screws 25 so that the seat 10 rotates with the shaft 14.

Freely journalled on the shaft 14 outwardly of the lugs 13 is a cover 16.

Extending rearwardly from and fixed to the outer ends of the shafts 14 are a pair of arms 17 each of which is provided with a weight 18. The length of the arms 17 and the mass of each of the weights 18, are chosen such that the weights 18 will raise the seat 10 by rotating the shaft 14, unless the cover 16 is lowered onto the seat 10, the weight of the cover being sufficient to prevent raising of the seat 10.

Mounted on the underneath surface of the seat 10, in a position to overlie the upper surface of the front of the toilet bowl 11, is a mounting plate 19 provided with a pair of spaced parallel downwardly directed walls 20. Mounted on the lower surface of the plate 19 is a suction cup 21 which is provided with an air bleed pipe 22 communicating with the space between the suction cup and the bowl 11, when the seat is in its lowered position.

A length of flexible tubing 23 is attached to the pipe 22, and passes through one of the walls 20 where it is contacted by the inner end of a grub screw 24 so that the rate of bleed of air from atmosphere to the suction cup 21, may be controlled by adjustment of the screw 24.

As will be appreciated, when the seat is lowered and pressed against the bowl 11 by the weight of the user, the suction cup 21 will be pressed firmly against the upper surface of the bowl, over-compression of the suction cup being prevented by the walls 20. When the user rises, operation of the weights 18 to lift the seat 10 will be prevented by the suction cup 21, until a sufficient quantity of air is bled to the suction cup through the tubing 23, to enable the weights to lift the suction cup 21 from engagement with the surface of the bowl 11.

In accordance with an important feature of the present invention, the resilience of the suction cup is so chosen that it is adequately pressed into engagement with the toilet bowl, not only by the weight of a user, but also by the weight of the toilet seat cover 16, so that when the cover 16 is lifted, the seat will remain in place for a sufficient length of time, adjusted by the screw 24, to avoid inconvenience to the user.

The suction cup 21 (of which there may if required be more than one) is therefore chosen in relation to the weight of the seat cover 16. The walls 20 are useful in preventing over-compression of the suction cup, as would otherwise be likely to occur in use, since the weight of the user will greatly exceed that of the lid.

In this way there is provided a toilet seat mechanism offering significant advantages in convenience, over the prior art referred to earlier. When the lid and cover have been left down, a suitably chosen time delay will be interposed between the lifting of the lid and the automatic raising of the seat, and this time delay will also occur before the seat is raised after use. The arrangement is well adapted to be manufactured in the form of a kit, usable with a specified range of toilet seats.

It will be appreciated that many details of construction shown in the illustrated embodiment, may be altered without departing from the scope of the present invention. For example, a spring or springs may be employed instead of the counter weights 18, and alternative arrangements may be provided for setting the time delay arrived at by the air bleed to the suction cup. Indeed, alternative devices providing a delayed release of the seat from the bowl may be employed. Further the counter balance mechanism is adjustable to accommodate different toilet seat weights and configurations.

What is claimed is:

1. A toilet seat assembly comprising a seat provided with mounting means for hinged mounting on a toilet bowl, and a seat cover provided with mounting means for hinged mounting on said toilet bowl such that said lid may be raised independently of said seat, means biasing said seat to its raised position, said biasing means being inoperative to raise said seat when said cover is in its lowered position said assembly further comprising at least one suction cup engaging and automatically releasing the seat from the bowl following a predetermined time delay after release of other restraint on upward movement of the seat.

2. A toilet seat assembly as defined in claim 1 further comprising means releasably engaging the seat with the bowl for a predetermined time delay after release of other restraint on upward movement of the seat.

3. A toilet seat assembly as defined in claim 2 wherein said engaging means being actuated into such engagement by the weight of said cover when said cover is in its lowered position.

4. A toilet seat assembly comprising:

a toilet seat and means for hingedly mounting said seat on a toilet bowl;

a toilet seat cover, and means for hingedly mounting said cover on a toilet bowl to selectively cover and engage said toilet seat;

means for biasing said seat to its raised position with a force sufficient to raise the seat when the cover is raised, but not when the seat cover is down and engaging the seat;

means for holding the seat down immediately adjacent the bowl for a predetermined time interval and then automatically releasing the seat from the bowl, said means including at least one suction cup located between the toilet seat and the toilet bowl.

5. A toilet seat assembly as defined in claim 4 wherein said suction cup is provided with means including an adjustable rate bleed valve for varying the release time of the suction cup.

6. A toilet seat mechanism comprising:

a seat provided with mounting means for hinged mounting on a toilet bowl;

means biasing said seat to its raised position; and means for engaging and automatically releasing the seat from the bowl following a predetermined time delay after release of other restraint on upward movement of the seat; and said engaging means including at least one suction cup located between the toilet seat and the toilet bowl.

7. A toilet seat assembly as defined in claim 6 wherein the biasing means comprises a counter balance mechanism.

8. The Invention as defined in claim 5 wherein the counter balance mechanism is adjustable to accommodate different toilet seat weights.

9. The Invention as defined in claim 6 wherein the biasing means includes at least one weight.

10. The Invention defined in claim 6 wherein each suction cup includes an adjustable rate bleed valve.

11. The Invention as defined in claim 6 wherein at least one mounting plate provided with a pair of spaced parallel downwardly projecting walls is mounted to the under surface of the seat to prevent over compression of the engaging means.

* * * * *

UNITED STATES PATENT AND TRADEMARK OFFICE

CERTIFICATE OF CORRECTION

PATENT NO. : 4,910,810

DATED : March 27, 1990

INVENTOR(S) : David S. Solomon

It is certified that error appears in the above-identified patent and that said Letters Patent are hereby corrected as shown below:

On the face page the correct name of the inventor is --David--.

Signed and Sealed this

Twelfth Day of November, 1991

*Attest:*

HARRY F. MANBECK, JR.

*Attesting Officer*

*Commissioner of Patents and Trademarks*